US009841039B2

(12) United States Patent
Adams et al.

(10) Patent No.: US 9,841,039 B2
(45) Date of Patent: Dec. 12, 2017

(54) MULTIVARIABLE ACTUATOR PRESSURE CONTROL

(71) Applicant: United Technologies Corporation, Hartford, CT (US)

(72) Inventors: Joshua Adams, New Hartford, CT (US); Martin Amari, Glastonbury, CT (US); Timothy J. Crowley, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 75 days.

(21) Appl. No.: 14/927,004

(22) Filed: Oct. 29, 2015

(65) Prior Publication Data

US 2017/0122345 A1 May 4, 2017

(51) Int. Cl.

| | |
|---|---|
| ***F15B 15/28*** | (2006.01) |
| ***F15B 15/08*** | (2006.01) |
| ***F15B 15/14*** | (2006.01) |
| ***F15B 11/10*** | (2006.01) |

(52) U.S. Cl.

CPC ..... *F15B 15/088* (2013.01); *F15B 11/10* (2013.01); *F15B 15/1447* (2013.01); *F15B 15/28* (2013.01)

(58) Field of Classification Search

CPC ..... F15B 9/00; F15B 9/02; F15B 9/09; F15B 2211/6336

USPC ..... 60/468, 494

See application file for complete search history.

(56) References Cited

U.S. PATENT DOCUMENTS 5,421,155 A * 6/1995 Hirata ..... B01D 53/28 60/426

6,662,705 B2 * 12/2003 Huang ..... F15B 11/006 60/459

* cited by examiner

*Primary Examiner* — Michael Leslie
*Assistant Examiner* — Daniel Collins
(74) *Attorney, Agent, or Firm* — Snell & Wilmer, L.L.P.

(57) ABSTRACT

Systems and methods for use with a variable pressure actuator control system for a gas turbine engine are provided. A variable pressure actuator control system for a gas turbine engine may comprise a controller, a pressure regulating electro-hydraulic servo valve assembly (P-EHSV), including a variable restriction flow path, in electronic communication with the controller, a position regulating electro-hydraulic servo valve assembly (X-EHSV), including a network of flow paths, in electronic communication with the controller, a bypass regulator (BPR) in fluid communication with at least one of a pump, the P-EHSV, or the X-EHSV, the BPR configured to be controlled by the P-EHSV via a bypass pressure to vary an available pressure, and an actuator comprising an actuator piston. The variable pressure actuator control system may minimize pressure when possible to increase mission capability for a gas turbine engine.

18 Claims, 6 Drawing Sheets

MULTIVARIABLE ACTUATOR PRESSURE CONTROL

FIELD

The present disclosure relates to gas turbine engine actuators, and, more specifically, to a system and method that compensates for changes in operating conditions of a multivariable system.

BACKGROUND

A gas turbine actuator control system can include a control system, a gas turbine engine having a plurality of engine actuators, a hydraulic (or fueldraulic) system, and a plurality of engine sensors. Generally, a fueldraulic system maintains a predetermined pressure available for actuator control. Typically, as the pressure increases in a fueldraulic system, the losses in the fueldraulic system increase. This drives a fuel temperature increase, which can lead to decreased mission capability for the gas turbine engine.

SUMMARY

A variable pressure actuator control system for a gas turbine engine may comprise a controller, a pressure regulating electro-hydraulic servo valve assembly (P-EHSV), including a flow path, in electronic communication with the controller, a position regulating electro-hydraulic servo valve assembly (X-EHSV), including a network of flow paths, in electronic communication with the controller, a bypass regulator (BPR) in fluid communication with at least one of a pump, the P-EHSV, or the X-EHSV, the BPR configured to be controlled by the P-EHSV via a bypass pressure to vary an available pressure, and an actuator comprising an actuator piston.

In various embodiments, the network of flow paths may comprise a second flow path, a third flow path, a fourth flow path, and a fifth flow path, wherein an extend pressure exists between the second flow path and the third flow path and a retract pressure exists between the fourth flow path and the fifth flow path. At least one of the retract pressure and the extend pressure may be controlled by the X-EHSV. The X-EHSV may be configured to control the network of flow paths. The actuator piston may be configured to extend in response to an increase in extend pressure and retract in response to an increase in retract pressure. The available pressure may be configured to remain minimal in response to a minimal requested available pressure. The available pressure may be configured to increase in response to at least one of an increase in requested pressure or a feedback signal having reached a limit. The variable pressure actuator control system may use hydraulic fluid.

A gas turbine engine may comprise a variable pressure actuator control system. The variable pressure actuator control system may comprise a controller, a pressure regulating electro-hydraulic servo valve assembly (P-EHSV), including a flow path, in electronic communication with the controller, a position regulating electro-hydraulic servo valve assembly (X-EHSV), including a network of flow paths, in electronic communication with the controller, a bypass regulator (BPR) in fluid communication with at least one of a pump, the P-EHSV, or the X-EHSV, the BPR configured to be controlled by the P-EHSV via a bypass pressure to vary an available pressure, and an actuator comprising an actuator piston.

In various embodiments, the network of flow paths may comprise a second flow path, a third flow path, a fourth flow path, and a fifth flow path, wherein an extend pressure exists between the second flow path and the third flow path and a retract pressure exists between the fourth flow path and the fifth flow path. At least one of the retract pressure and the extend pressure may be controlled by the X-EHSV. The X-EHSV may be configured to control the network of flow paths. The actuator piston may be configured to extend in response to an increase in extend pressure and retract in response to an increase in retract pressure. The available pressure may be configured to remain minimal in response to a minimal requested available pressure. The available pressure may be configured to increase in response to a feeback signal having reached a limit. The variable pressure actuator control system may use hydraulic fluid.

A method of controlling a variable pressure actuator control system for a gas turbine engine may comprise: receiving, by a controller, at least one of a goal signal, a limit signal, and a sensor output signal, calculating, by the controller, at least one of a pressure signal and a position signal, sending, by the controller, at least one of the pressure signal and the position signal, receiving, by a pressure regulating electro-hydraulic servo valve assembly (P-EHSV), the pressure signal, receiving, by a position regulating electro-hydraulic servo valve assembly (X-EHSV), the position signal, and increasing, by the controller, an available pressure.

In various embodiments, the increasing may be in response to a feedback signal having reached a limit. In various embodiments, the method may further comprise decreasing, by the controller, the available pressure. In various embodiments, the decreasing may be in response to a decrease in desired pressure at an actuator piston.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

Figure 1:
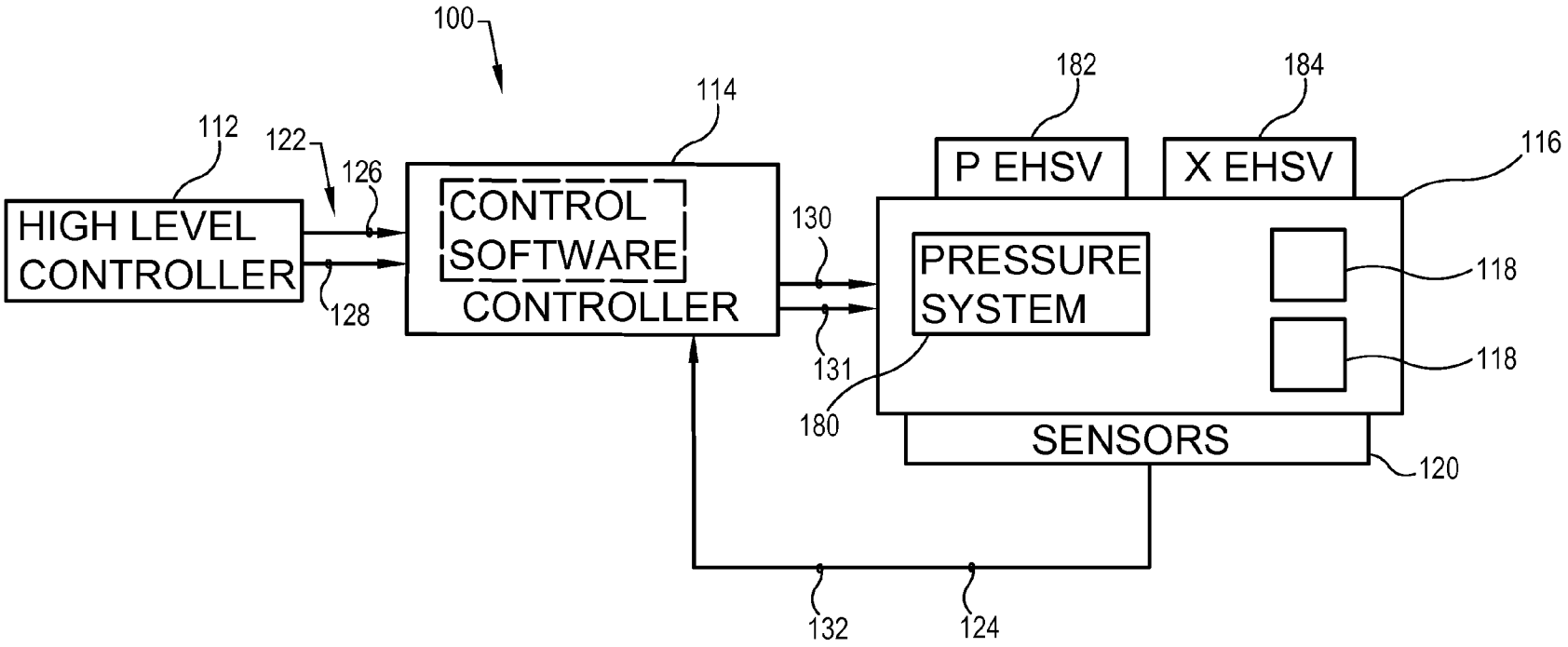
FIG. 1 illustrates a schematic view of a variable pressure actuator control system, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials. In some cases, reference coordinates may be specific to each figure.

In various embodiments, the variable pressure control system as disclosed herein includes a hydraulic system which is capable of varying available system pressure in response to a high level control request. Variable available system pressure may reduce system temperatures, resulting in higher engine operating efficiencies. According to the present disclosure, a pressure regulating electro-hydraulic servo valve assembly (P-EHSV) may control available pressure in a hydraulic system. A position regulating electro-hydraulic servo valve assembly (X-EHSV) may control the position of an actuator piston by controlling retract pressures and extend pressures in the system. An actuator may retract in response to an increase in a retract pressure and may extend in response to an increase in an extend pressure. Thus, a retract pressure and an extend pressure may be the pressure which the actuator experiences via a supplied fluid. A constrained model based controller may determine appropriate available pressure, while tending to minimize available pressure, to achieve various benefits.

The term "effector signal" is used herein to describe a command signal that controls operation of the engine through the engine actuators. The effector signals can be generated by processing goals and/or limits using a control algorithm such that at least some of the goals are satisfied, subject to each limit being held (i.e., no limit is violated). An example of a goal is to move an actuator at a predetermined rate to a predetermined position. An example of a limit (i.e., a maximum or minimum) is to prevent the hydraulic pressure applied at an actuator piston from exceeding a certain value. A limit is "active" when its limit value has been met; e.g., when a temperature of a component is, or is predicted to be, at or above a maximum limit temperature.

System program instructions and/or controller instructions may be loaded onto a non-transitory, tangible computer-readable medium having instructions stored thereon that, in response to execution by a controller, cause the controller to perform various operations. The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in *In Re Nuijten* to fall outside the scope of patentable subject matter under 35 U.S.C. §101.

In various embodiments, an electro-hydraulic servo valve (EHSV) as used herein may comprise a directional control valve, wherein the EHSV consists of a spool, or the like, inside of a cylinder which is electronically controlled. For example, an EHSV may receive actuation commands to open, partially open, partially close and/or close various flow paths. The movement of the spool restricts or permits the flow of a hydraulic fluid. As described herein a position regulating electro-hydraulic servo valve (X-EHSV) may comprise one or more inputs and four outputs, in accordance with various embodiments. In various embodiments, each output may comprise a port, orifice, valve, or the like, referred to herein as a flow path, which may comprise a variable restriction flow path. Similarly, a pressure regulating electro-hydraulic servo valve (P-EHSV) is provided, in accordance with various embodiments. The P-EHSV may comprise one or more inputs and one or more outputs, in accordance with various embodiments. In this light, an EHSV may comprise a valve assembly.

Referring to FIG. 1, a variable pressure actuator control system 100 is schematically illustrated, in accordance with various embodiments. Variable pressure actuator control system 100 may include a high level controller 112 (e. g., a vehicle management system), a control system 114, a gas turbine engine 116 having a plurality of actuators 118, and a plurality of engine sensors 120. In various embodiments, control system 114 may be referred to herein as a controller. The control system 114 is wired or wirelessly in communication with to the high level controller 112, the gas turbine engine 116 via the engine actuators 118, and the engine sensors 120. The engine sensors 120 are disposed with the gas turbine engine 116.

The control system 114 inputs one or more control signals 122 from the high level controller 112 and one or more sensor output signals 124 from the engine sensors 120. The control signals 122 can include one or more goals 126 (also referred to as "command signals") and one or more limits 128. A signal indicative of a command to move an actuator at a predetermined rate to a predetermined position, as indicated above, is an example of a goal. A signal indicative of a control limit (i.e., a maximum or minimum) to prevent a hydraulic pressure applied at an actuator piston from exceeding a certain pressure, as indicated above, is an example of a limit.

Although described herein as comprising separate controllers, in various embodiments, control system 114 and high level controller 112 may comprise a single controller. For example, control system 114 may refer to system program instructions and/or controller instructions which may be loaded onto a non-transitory, tangible computer-readable medium and high level controller 112 may refer to system program instructions and/or controller instructions which may be loaded onto the same non-transitory, tangible computer-readable medium. Thus, control system 114 and high level controller 112 comprising a single controller.

The control system 114 provides one or more effector signals 130, 131 to one or more of the engine actuators 118. The term "effector signal" is used herein, as indicated above, to refer to a command signal that controls operation of an engine actuator. Effector signal 130 and effector signal 131 are generated, as a function of the control and sensor output signals 122 and 124, to control operation of the engine 116 by controlling the engine actuators 118. Although illustrated in FIG. 1 as two separate signals, effector signal 130 and effector signal 131 may comprise a single signal, in accordance with various embodiments.

The engine sensors 120 monitor certain engine parameters such as temperature, pressure, actuator position, etc. The engine sensors 120 output measured parameter data 132 to the control system 114, via the sensor output signals 124 (i.e., feedback signals), indicative of the monitored engine parameters. A signal indicative of temperature, pressure, or actuator position that is measured by an engine sensor is an example of a sensor output signal.

Figure 2:
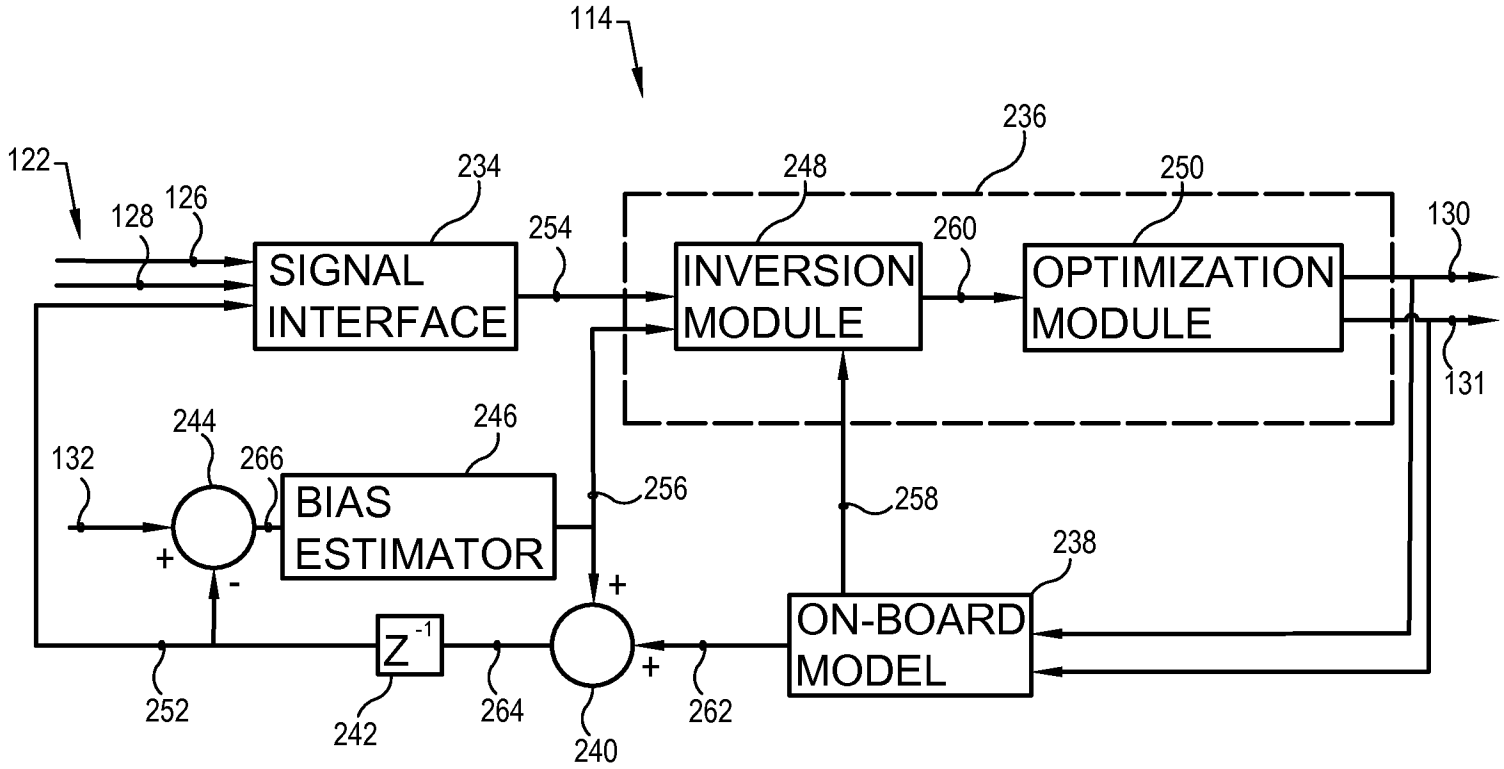
FIG. 2 illustrates a schematic view of a control system, in accordance with various embodiments.
Figure 3:
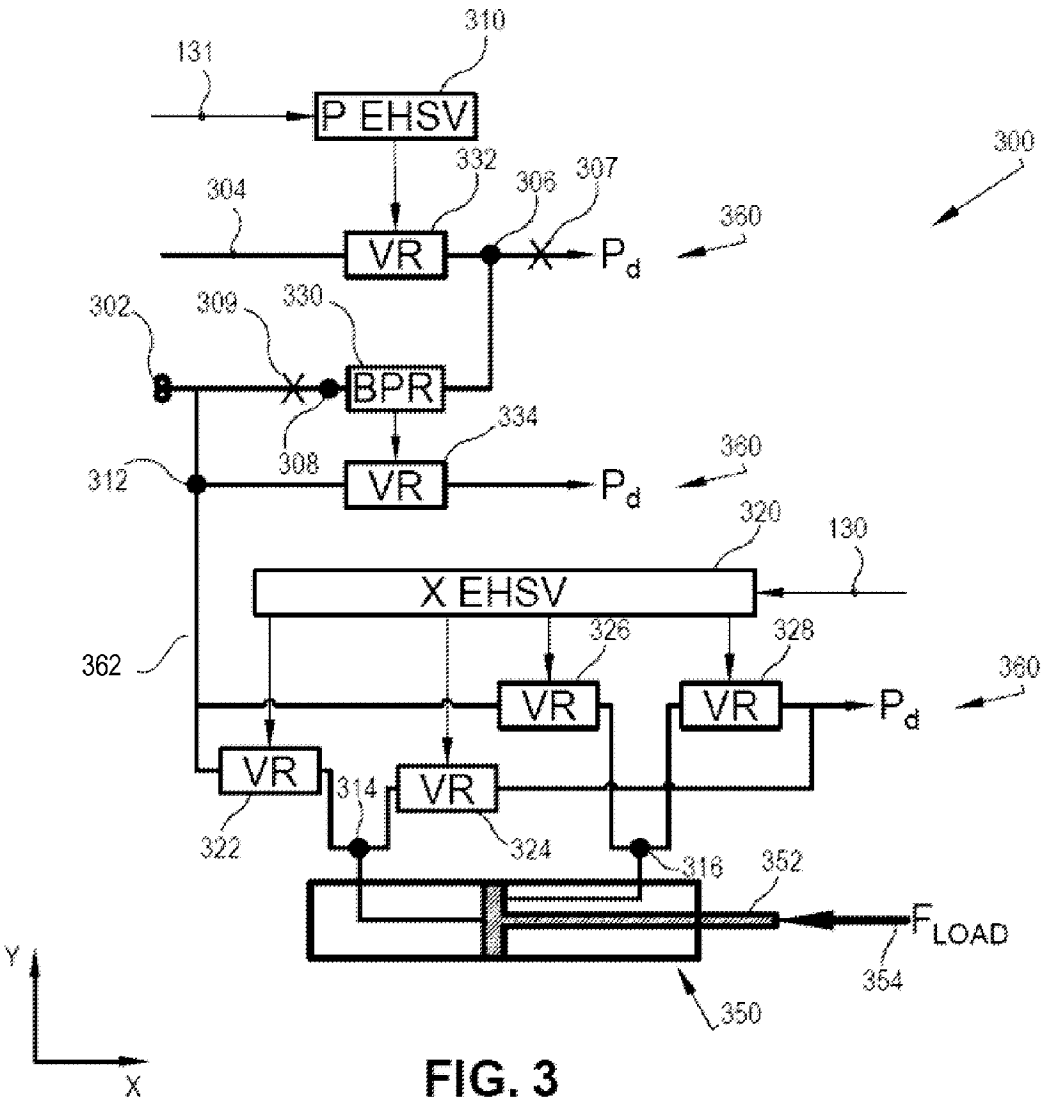
FIG. 3 illustrates a schematic view of an actuator pressure control system, in accordance with various embodiments.

With respect to FIG. 2 and FIG. 3, elements with like element numbering as depicted in FIG. 1 are intended to be the same and will not necessarily be repeated for the sake of clarity.

With reference to FIG. 2, the control system 114 may include a control signal interface 234, an effector signal generator 236, an actuation system modeling device 238, a prediction signal biasing device 240, a memory storage device 242, a comparator 244, and/or a bias estimator 246. The effector signal generator 236 may include a dynamic inversion module 248 and/or an optimization module 250.

Although described herein as being implemented on control system 114, it is contemplated that control signal interface 234, effector signal generator 236, actuation system modeling device 238, prediction signal biasing device 240, memory storage device 242, comparator 244, and bias estimator 246 may be implemented on one or more controllers and in any combination thereof.

The control signal interface 234 receives the control signals 122 (i.e., the goals 126 and limits 128) from the high level controller 112 (see FIG. 1), and stored parameter data 252 from the memory storage device 242. The control signal interface 234 provides reference value data 254 to the dynamic inversion module 248. The dynamic inversion module 248 receives bias estimates 256 from the bias estimator 246 and model term data 258 from the actuation system modeling device 238. The dynamic inversion module 248 provides effector equation data 260 to the optimization module 250. The optimization module 250 provides one or more effector signals 130, 131 to one or more of the engine actuators 118 (see FIG. 1), and the actuation system modeling device 238. The actuation system modeling device 238 provides predicted parameter data 262 to the prediction signal biasing device 240. The prediction signal biasing device 240 receives the bias estimates 256 from the bias estimator 246, and provides biased predicted parameter data 264 to the memory storage device 242. The predicted parameter data 264 includes predictions of the values of states and variables that have associated goals or limits at the next control process cycle. The comparator 244 receives the stored parameter data 252 from the memory storage device 242, and the measured parameter data 132 from one or more of the engine sensors 120 (see FIG. 1). The stored parameter data 252 includes estimates of the current values of states and variables that have associated goals or limits the comparator 244 provides prediction error data 266 to the bias estimator 246, which processes this data to produce bias estimates 256. The bias estimates correct for model error. The bias estimates include at least one bias which, when added to at least one predicted parameter data 262, corrects the output for model error.

The control signal interface 234 is configured to generate the reference value data 254 by processing the goals 126, the limits 128 and the stored parameter data 252 using a reference model. The reference model is operable to reflect a desired future dynamic response to possibly changing goals and limits. The reference value data 254 is indicative of a desired value of one or more goals and one or more limits, which are determined for a subsequent (e.g., the next) control process cycle (also referred to as a "program cycle" or "update"). A numerical value indicative of a hydraulic pressure that corresponds to an actuator position is an example of a goal value. In various embodiments, each goal can also be associated with one or more additional signals such as 1) a reference value of hydraulic pressure included in the reference value data 254 indicative of the desired hydraulic pressure dynamic response to the goal, 2) a model prediction of actual hydraulic pressure included in the predicted parameter data 262, 3) a sensor measurement of actual hydraulic pressure included in the measured parameter data 132, and/or 4) a hydraulic pressure bias to correct for model errors. A numerical value indicative of a maximum actuator displacement rate is an example of a limit value. In various embodiments, each limit can also be associated with one or more additional signals such as: a reference value of actuator piston displacement rate included in the reference value data 254 indicative of the desired actuator displacement rate dynamic response to the possibly changing limit value, a model prediction of actual actuator displacement rates included in the predicted parameter data 262, a sensor measurement of actual actuator displacement rates included in the measured parameter data 132, and/or a actuator displacement rate bias to correct for model errors.

With reference to FIG. 3, an actuator pressure control system 300 is provided. An xy-axis is provided for ease of illustration. In various embodiments, an actuator pressure control system 300 may include a pump 302, a pressure regulating electro-hydraulic servo valve assembly (P-EHSV) 310, a position regulating electro-hydraulic servo valve assembly (X-EHSV) 320, a bypass regulator (BPR) 330, and at least one actuator 350. In various embodiments, pump 302 may be a fixed displacement pump.

In various embodiments, P-EHSV 310 may include flow path 332. In various embodiments, flow path 332 may comprise a variable restriction (VR) flow path.

In various embodiments, X-EHSV 320 may include flow path 322, flow path 324, flow path 326, and/or flow path 328. In various embodiments, flow path 322, flow path 324, flow path 326, and/or flow path 328 may comprise a variable restriction (VR) flow path. Flow path 322 may be referred to herein as a second flow path. Flow path 324 may be referred to herein as a third flow path. Flow path 326 may be referred to herein as a fourth flow path. Flow path 328 may be referred to herein as a fifth flow path. Flow path 322, flow path 324, flow path 326, and flow path 328 may be collectively referred to herein as a network of flow paths.

In various embodiments, BPR 330 may include flow path 334. In various embodiments, flow path 334 may comprise a variable restriction (VR) flow path. Flow path 334 may be referred to herein as a sixth flow path.

In various embodiments, pump 302 may be in fluid communication with BPR 330. In various embodiments, pump 302 may be in fluid communication with BPR 330 via fixed restriction 309. In various embodiments, pump 302 may be in fluid communication with BPR 330 via conduit 362. In various embodiments, pump 302 may be in fluid communication with X-EHSV 320. In various embodiments, pump 302 may be in fluid communication with X-EHSV 320 via conduit 362, for example. In various embodiments, BPR 330 may be in fluid communication with X-EHSV 320. In various embodiments, BPR 330 may be in fluid communication with P-EHSV 310. In various embodiments, BPR 330 may be in fluid communication with actuator piston 352 via X-EHSV 320.

In various embodiments, P-EHSV 310 may be in electronic communication with control system 114 (see FIG. 1). In various embodiments, P-EHSV 310 may comprise an electronics controller. In various embodiments, X-EHSV 320 may be in electronic communication with control system 114 (see FIG. 1). In various embodiments, X-EHSV 320 may comprise an electronics controller.

In various embodiments, P-EHSV may receive effector signal 131. Effector signal 131 may be a pressure command signal. In various embodiments, effector signal 131 may comprise a value or a current, such as a desired pressure, for example. P-EHSV 310 may be configured to one of restrict or permit hydraulic fluid to flow through flow path 332, in response to effector signal 131. In various embodiments, flow path 332 may receive pressurized hydraulic fluid at a regulated pressure 304. In various embodiments, regulated pressure 304 may be maintained by an outside hydraulic system. In various embodiments, hydraulic fluid may flow through flow path 332 to drain 360 and/or to BPR 330. A fixed restriction 307 may be located between drain 360 and flow path 332. In various embodiments, drain 360 may comprise a tank. Flow path 332 may be configured to open in response to a command for an increase in bypass pressure 306 and close in response to a command for a decrease in bypass pressure 306. Bypass pressure 306 may be configured to increase in response to effector signal 131 commanding more pressure to be applied at actuator piston 352. Bypass pressure 306 may be configured to decrease in response to effector signal 131 commanding less pressure to be applied at actuator piston 352. In various embodiments, bypass pressure 306 may be configured to control BPR 330. For example, in various embodiments, a change in bypass pressure 306 may reduce the size of the flowpath for flow of hydraulic fluid through BPR 330, thus increasing available pressure 312.

Pump 302 may supply a constant flow of pressurized hydraulic fluid to actuator pressure control system 300. Damping pressure 308 may exist between fixed restriction 309 and BPR 330. Hydraulic fluid may flow from pump 302, through flow path 334, into drain 360. BPR 330 may control flow path 334. Flow path 334 may open to decrease available pressure 312. Flow path 334 may close to increase available pressure 312. Accordingly, BPR 330 and/or available pressure 312 may be controlled by P-EHSV 310.

In various embodiments, hydraulic fluid may flow at available pressure 312 to flow path 322 and flow path 326. Hydraulic fluid may flow through flow path 322, through flow path 324, and into drain 360. Hydraulic fluid may flow through flow path 326, through flow path 328, and into drain 360. Hydraulic fluid located between flow path 322 and flow path 324 may comprise extend pressure 314. Hydraulic fluid located between flow path 326 and flow path 328 may comprise retract pressure 316. Extend pressure 314 may be increased to extend actuator piston 352. Retract pressure 316 may be decreased to extend actuator piston 352. Retract pressure 316 may be increased to retract actuator piston 352. Extend pressure 314 may be decreased to retract actuator piston 352.

In various embodiments, X-EHSV 320 may receive effector signal 130. Effector signal 130 may be a position command signal. In various embodiments, effector signal 130 may comprise a value or a current, such as an actuator position value, for example. X-EHSV 320 may be configured to one of restrict or permit hydraulic fluid to flow through flow path 322, flow path 324, flow path 326, and/or flow path 328 in response to effector signal 130. Stated another way, X-EHSV 320 may be configured to open and or close at least one of flow path 322, flow path 324, flow path 326, and/or flow path 328 in response to effector signal 130. Accordingly, actuator piston 352 may be configured to at least one of extend (in the positive x-direction) or retract (in the negative x-direction) in response to effector signal 130. Accordingly, extend pressure 314 and/or retract pressure 316 may be controlled by X-EHSV 320.

In various embodiments, extend pressure 314 and retract pressure 316 may be limited by available pressure 312. For example, a limit may be reached by extend pressure 314 and thus X-EHSV 320 when extend pressure 314 has reached available pressure 312. For example, extend pressure 314 may be equal to available pressure 312 when flow path 324 is in a closed position and flow path 322 is in an open position. Thus, the pressure of hydraulic fluid supplied to actuator 350 may be limited by available pressure 312.

In various embodiments, available pressure 312 may be configured to increase in response to a feedback signal having reached a limit. Stated another way, available pressure 312 may be configured to increase in response to control system 114 (see FIG. 2) having reached a limit. A feedback signal may include the value of an operating condition of actuator pressure control system 300. In various embodiments, a feedback signal may include a rate of change of the position of actuator piston 352. A feedback signal may include an error in the rate of change of the position of actuator piston 352. A feedback signal may include an error of the position of actuator piston 352. A feedback signal may include a rate of change of extend pressure 314 and/or retract pressure 316. A feedback signal may include an error in the rate of change of extend pressure 314 and/or retract pressure 316. A feedback signal may include an error in extend pressure 314 and/or retract pressure 316. A feedback signal may include available pressure 312. In various embodiments, a feedback signal may be supplied to a controller, such as control system 114 (see FIG. 2) for example, via a sensor or the like. Accordingly, actuator pressure control system 300 may include one or more sensors.

Accordingly, available pressure 312 may be configured to remain minimal when minimal available pressure 312 is desired by actuator pressure control system 300. Accordingly, available pressure 312 may be configured to decrease in response to a decrease in desired pressure applied to actuator piston 352. Minimizing available pressure 312 may result in lower operating temperatures and better engine mission capability.

In various embodiments, load force 354 may be a force acting on actuator piston 352. Load force 354 may be, for example, a force transmitted through an engine nozzle in response to exhaust pressure in the nozzle. In various embodiments, extend pressure 314 and retract pressure 316 may be configured to prevent actuator piston 352 from moving in response to load force 354. In various embodiments, extend pressure 314 and retract pressure 316 may be configured to extend or retract actuator piston 352, thus opening or closing an engine nozzle, for example. In various embodiments, the pressure applied to actuator piston 352 may be determined using load force 354.

Hydraulic fluid in actuator pressure control system 300 may comprise fuel, or any other suitable fluid. Sensors may be used in actuator pressure control system 300 to detect parameters such as pressure, temperature, and position.

Figure 4:
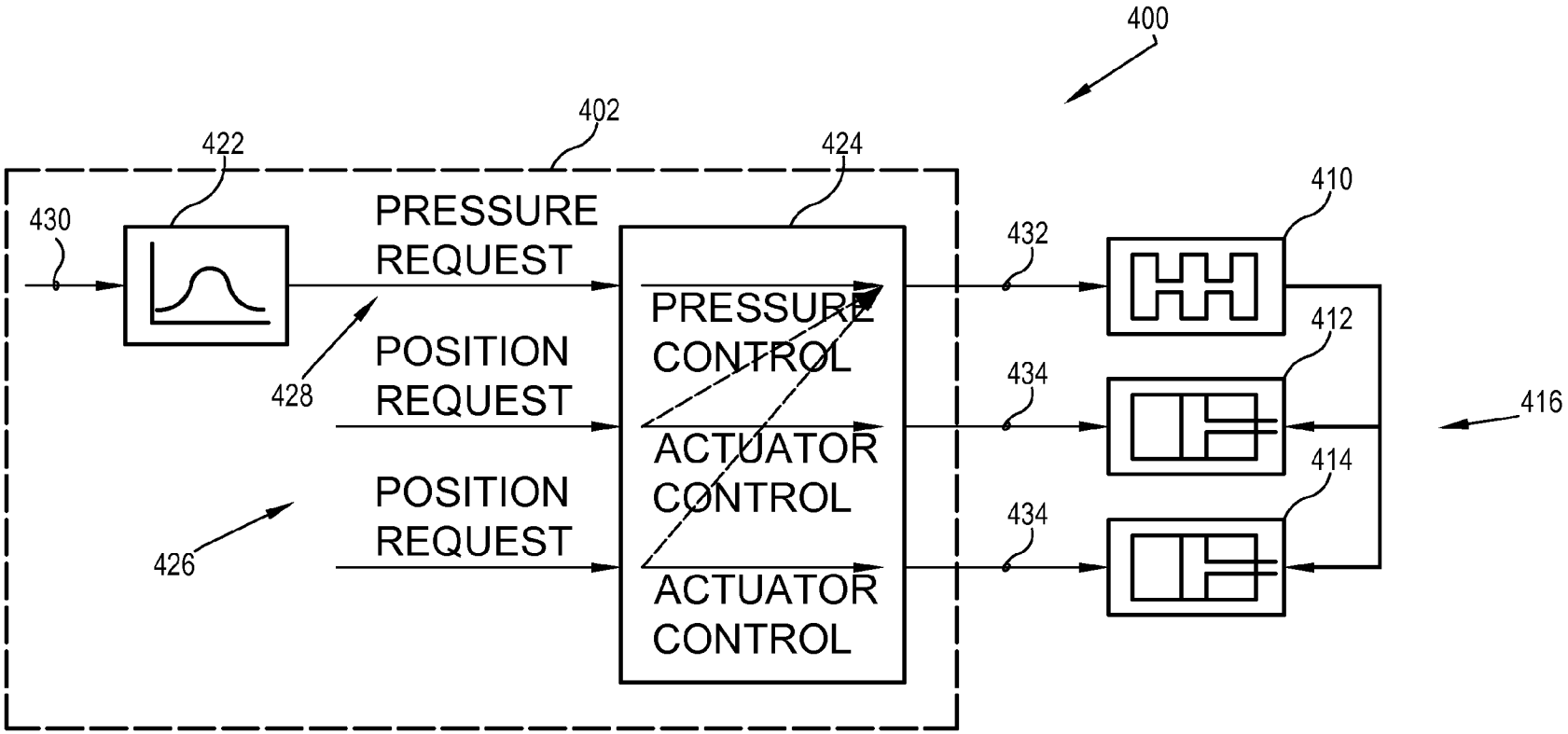
FIG. 4 illustrates a schematic view of a variable pressure control system, in accordance with various embodiments.

In various embodiments, FIG. 4 illustrates a variable pressure control system 400. In various embodiments, variable pressure control system 400 may be similar to variable pressure actuator control system 100. In various embodiments, variable pressure control system 400 may comprise model based controller (MBC) 402, a hydraulic pressure system 410, and a plurality of actuators such as actuator 412 and actuator 414, for example. MBC 402 may comprise an on-board model 422 and actuation controller 424.

In various embodiments, on-board model 422 may receive a plurality of signals 430. Plurality of signals 430 may include signals such as pre-predicted model requests, position requests, actuator positions, and feedback signals, for example.

In various embodiments, actuation controller 424 may receive a plurality of signals including pressure request 428 and plurality of position requests 426, for example. In various embodiments, actuation controller 424 may determine or calculate a plurality of effector signals such as pressure signal 432 and plurality of position signals 434, for example. In various embodiments, actuation controller 424 may comprise a single loop system.

In various embodiments, plurality of position requests 426 may be used to determine pressure signal 432. For example, if an increase in available pressure is desired to reach a predetermined position, the value of pressure signal 432 may be varied according to the desired pressure. Plurality of position signals 434 may be calculated based on plurality of position requests 426. Plurality of position signals 434 may be calculated based on various parameters such as load forces, available pressure, rate of change limits, etc. In various embodiments, plurality of position signals 434 may control the position of actuator 412 and/or actuator 414. Thus, actuator 412 and/or actuator 414 may be in electronic communication with MBC 402.

In various embodiments, pressure signal 432 may be received by hydraulic pressure system 410. Thus, hydraulic pressure system 410 may be in electronic communication with MBC 402. In various embodiments, hydraulic pressure system 410 may supply hydraulic pressure to a plurality of actuators such as actuator 412 and actuator 414, for example. Accordingly, hydraulic pressure system 410 may be in fluid communication with the plurality of actuators. In various embodiments, hydraulic pressure system 410 may be similar to actuator pressure control system 300, as described herein.

Figure 5:
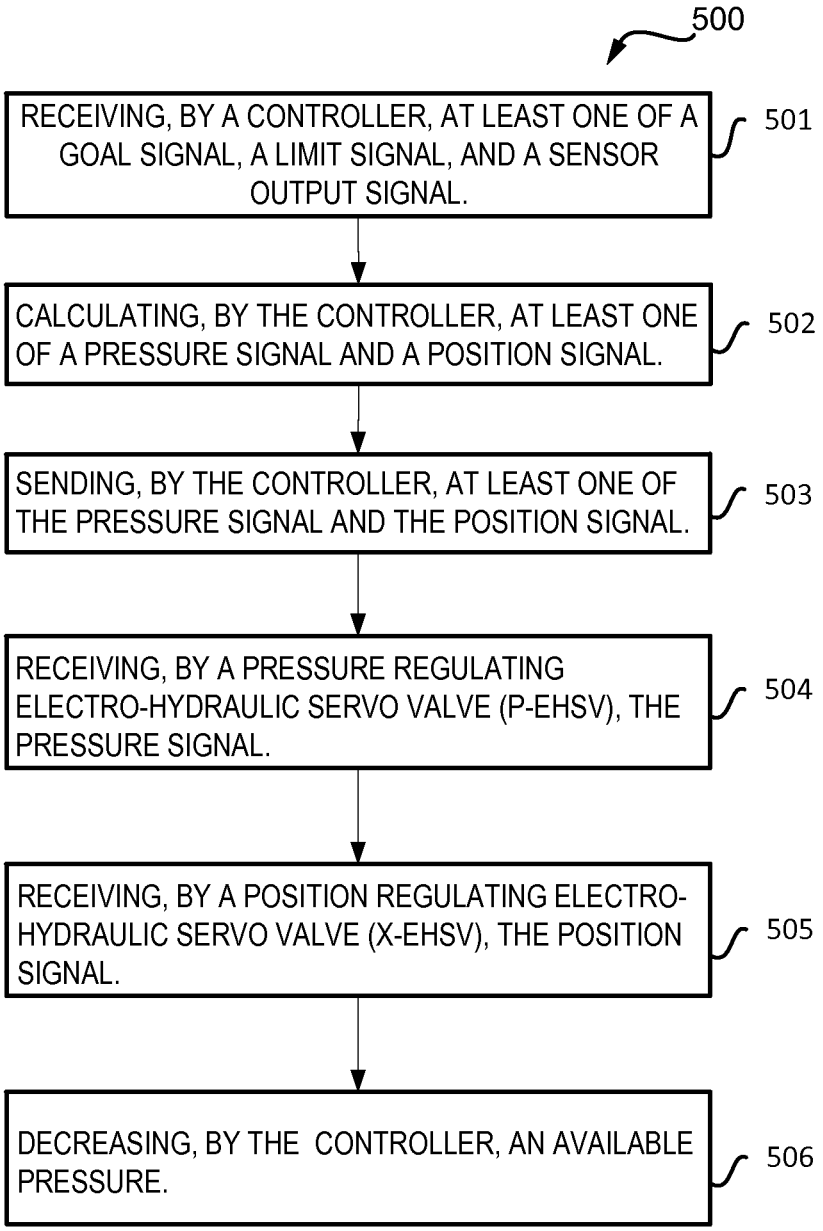
FIG. 5 illustrates a method of controlling a variable pressure actuator control system, in accordance with various embodiments.

With reference to FIG. 5, a method 500 for controlling a variable pressure actuator control system is provided. Method 500 may comprise receiving, by a controller, at least one of a goal signal, a limit signal, and a sensor output signal (see step 501). Method 500 may comprise calculating, by the controller, at least one of a pressure signal and a position signal (see step 502). Method 500 may comprise sending, by the controller, at least one of the pressure signal and the position signal (see step 503). The pressure signal may be sent to a pressure regulating electro-hydraulic servo valve assembly (P-EHSV). The position signal may be sent to a position regulating electro-hydraulic servo valve assembly (X-EHSV). Method 500 may comprise receiving, by a pressure regulating electro-hydraulic servo valve assembly (P-EHSV), the pressure signal (see step 504). The pressure signal may be received from the controller. Method 500 may comprise receiving, by a position regulating electro-hydraulic servo valve assembly (X-EHSV), the position signal (see step 505). The position signal may be received from the controller. Method 500 may comprise decreasing, by the controller, an available pressure (see step 506).

Figure 6:
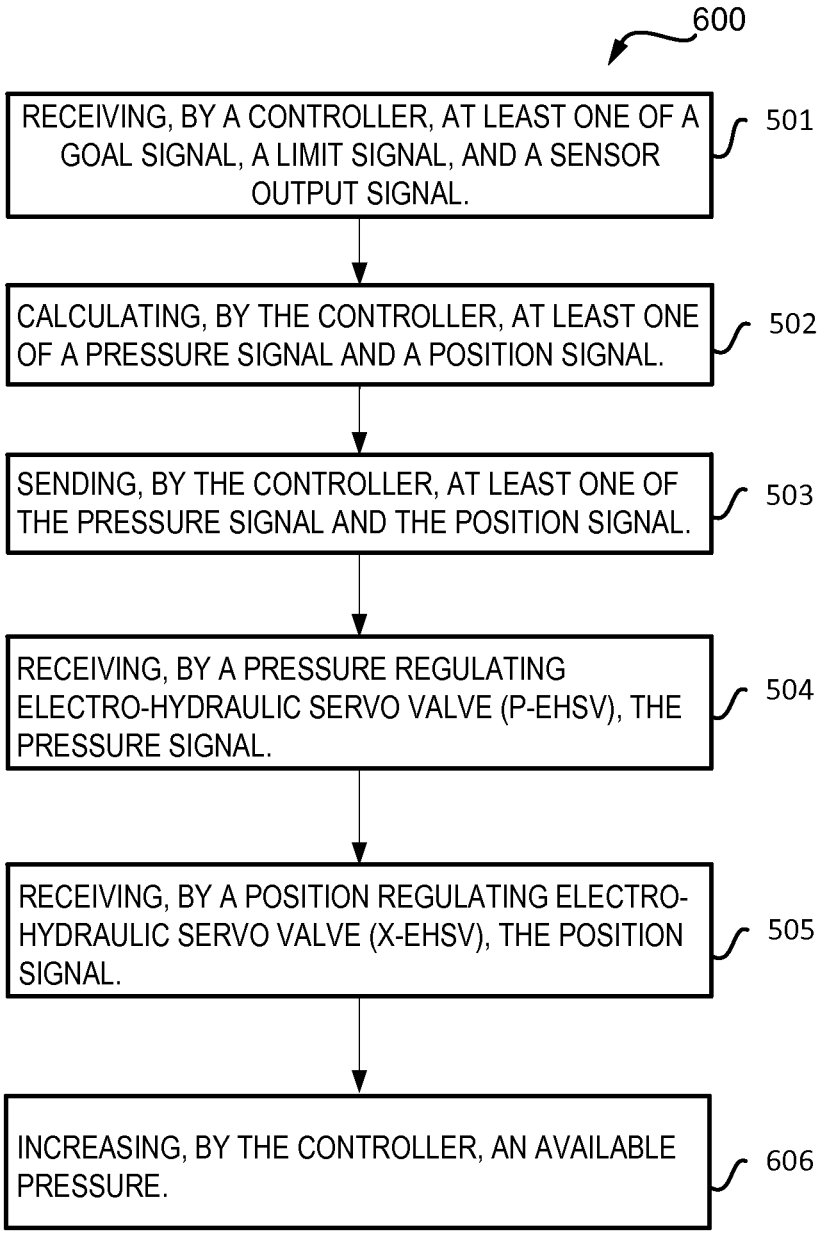
FIG. 6 illustrates a method of controlling a variable pressure actuator control system, in accordance with various embodiments.

With respect to FIG. 6, elements with like element numbering as depicted in FIG. 5, are intended to be the same and will not be repeated for the sake of clarity. Method 600 as illustrated in FIG. 6 may be similar to method 500 as illustrated in FIG. 5. In various embodiments, method 600 may comprise increasing, by the variable pressure actuator control system, an available pressure (see step 606).

With reference now to FIG. 1 and FIG. 5, step 501 may include receiving, by control system 114, at least one of goals 126, limits 128, and sensor output signals 124. Step 502 may include calculating, by control system 114, at least one of effector signal 130 and effector signal 131. Step 503 may include sending, by control system 114, at least one of effector signal 130 and effector signal 131. Effector signal 131 may be sent to pressure regulating electro-hydraulic servo valve assembly (P-EHSV) 182. Effector signal 130 may be sent to a position regulating electro-hydraulic servo valve assembly (X-EHSV) 184. Effector signal 130 and effector signal 131 may be sent to one or more of engine actuators 118 via at least one of P-EHSV 182 and X-EHSV 184. Step 504 may include receiving, by P-EHSV 182, effector signal 131. Effector signal 131 may be received from control system 114. Step 505 may include receiving, by X-EHSV 184, effector signal 130. Effector signal 130 may be received from control system 114. Step 506 may include decreasing, by control system 114, available pressure 312 (see FIG. 3). With reference now to FIG. 1 and FIG. 6, step 606 may include increasing, by control system 114, available pressure 312 (see FIG. 3).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A variable pressure actuator control system for a gas turbine engine comprising:

a controller;

a pressure regulating electro-hydraulic servo valve assembly (P-EHSV), including a variable restriction flow path, in electronic communication with the controller;

a position regulating electro-hydraulic servo valve assembly (X-EHSV), including a network of flow paths, in electronic communication with the controller;

a bypass regulator (BPR) in fluid communication with at least one of a pump, the P-EHSV, or the X-EHSV, the BPR configured to be controlled by the P-EHSV via a bypass pressure to vary an available pressure; and an actuator comprising an actuator piston;

wherein the available pressure is configured to remain minimal in response to a minimal requested available pressure.

2. The system of claim 1, wherein the network of flow paths comprise a second flow path, a third flow path, a fourth flow path, and a fifth flow path, wherein an extend pressure exists between the second flow path and the third flow path and a retract pressure exists between the fourth flow path and the fifth flow path.

3. The system of claim 2, wherein at least one of the retract pressure and the extend pressure is controlled by the X-EHSV.

4. The system of claim 1, wherein the X-EHSV is configured to control the network of flow paths.

5. The system of claim 1, wherein the actuator piston is configured to extend in response to an increase in extend pressure and retract in response to an increase in retract pressure.

6. The system of claim 1, wherein the available pressure is configured to increase in response to at least one of an increase in requested pressure or a feedback signal having reached a limit.

7. The system of claim 1, wherein the variable pressure actuator control system uses hydraulic fluid.

8. A gas turbine engine comprising:

a variable pressure actuator control system comprising:

a controller;

a pressure regulating electro-hydraulic servo valve assembly (P-EHSV), including a variable restriction flow path, in electronic communication with the controller;

a position regulating electro-hydraulic servo valve assembly (X-EHSV), including a network of flow paths, in electronic communication with the controller;

a bypass regulator (BPR) in fluid communication with at least one of a pump, the P-EHSV, or the X-EHSV, the BPR configured to be controlled by the P-EHSV via a bypass pressure to vary an available pressure; and an actuator comprising an actuator piston;

wherein the available pressure is configured to remain minimal in response to a minimal requested available pressure.

9. The gas turbine engine of claim 8, wherein the network of flow paths comprise a second flow path, a third flow path, a fourth flow path, and a fifth flow path, wherein an extend pressure exists between the second flow path and the third flow path and a retract pressure exists between the fourth flow path and the fifth flow path.

10. The gas turbine engine of claim 9, wherein at least one of the retract pressure and the extend pressure is controlled by the X-EHSV.

11. The gas turbine engine of claim 8, wherein the X-EHSV is configured to control the network of flow paths.

12. The gas turbine engine of claim 8, wherein the actuator piston is configured to extend in response to an increase in extend pressure and retract in response to an increase in retract pressure.

13. The gas turbine engine of claim 8, wherein the available pressure is configured to increase in response to a feedback signal having reached a limit.

14. The gas turbine engine of claim 8, wherein the variable pressure actuator control system uses hydraulic fluid.

15. A method of controlling a variable pressure actuator control system for a gas turbine engine comprising:

receiving, by a controller, at least one of a goal signal, a limit signal, and a sensor output signal;

calculating, by the controller, at least one of a pressure signal and a position signal;

sending, by the controller, at least one of the pressure signal and the position signal;

receiving, by a pressure regulating electro-hydraulic servo valve assembly (P-EHSV), the pressure signal;

receiving, by a position regulating electro-hydraulic servo valve assembly (X-EHSV), the position signal; and increasing, by the controller, an available pressure.

16. The method of claim 15, wherein the increasing is in response to a feedback signal having reached a limit.

17. The method of claim 15, further comprising, decreasing, by the controller, the available pressure.

18. The method of claim 17, wherein the decreasing is in response to a decrease in desired pressure at an actuator piston.

* * * * *